US005969513A

United States Patent [19]

Clark

[11] Patent Number: 5,969,513

[45] Date of Patent: Oct. 19, 1999

[54] SWITCHED CAPACITOR CURRENT SOURCE FOR USE IN SWITCHING REGULATORS

[75] Inventor: William A. Clark, Fremont, Calif.

[73] Assignee: Volterra Semiconductor Corporation, Fremont, Calif.

[21] Appl. No.: 09/047,317

[22] Filed: Mar. 24, 1998

[51] Int. Cl.[6] ..... G05F 1/40; G05F 3/16

[52] U.S. Cl. ..... 323/282; 323/288; 323/312; 323/317

[58] Field of Search ..... 323/288, 312, 323/315, 316, 317, 282; 307/263

[56] References Cited

U.S. PATENT DOCUMENTS 5,422,562 6/1995 Mammano et al. .

OTHER PUBLICATIONS

Severns et al., *Modern DC–to–DC Switchmode Power Converter Circuits*, Van Nostrand Reinhold Co., NY, 11–77.

Lloyd Dixon, "Average Current Mode Control of Switching Power Supplies," *Unitrode Switching Regulated Power Supply Design Seminar Manual*, Unitrode Corporation, C1–1 to C1–14, 1991.

Lloyd Dixon, "Switching Power Supply Topology Review," *Unitrode Switching Regulated Power Supply Design Seminar Manual*, P1–1 to P1–12, 1991.

Kassakian et al., "DC/DC Converters," *Principles of Power Electronics*, Addison–Wesley Publishing Co., Sec. 2.3, 20–23, 1991.

Kassakian et al., "High–Frequency Switching dc/dc Converters," *Principles of Power Electronics*, Addison–Wesley Publishing Co., Chapter 6, 103–137, 1991.

Kassakian et al., "Dynamics and Control: An Overview," *Principles of Power Electronics*, Addison–Wesley Publishing Co., Chapter 11, 253–298, 1991.

Kassakian et al., "Discrete–Time or Sampled–Data Models," *Principles of Power Electronics*, Addison–Wesley Publishing Co., Sec. 12.5, 313–315, 1991.

Kassakian et al., "Feedback Control Design," *Principles of Power Electronics*, Addison–Wesley Publishing Co., Chapter 14, 365–402, 1991.

*Primary Examiner*—Peter S. Wong
*Assistant Examiner*—Rajnikant B. Patel
*Attorney, Agent, or Firm*—Fish & Richardson P.C.

[57] ABSTRACT

In voltage regulator with a power switch to alternately couple and decouple an input voltage source to an output terminal at a switching frequency, a current supply provides a current that is proportional to the input voltage, the capacitance of a ramp capacitor, and a switching frequency. To provide this current, a first capacitor is charged to a first voltage, the first capacitor is discharged to a second voltage through a variable current source at a rate which is controlled by a third voltage on a second capacitor, the first capacitor is connected to the second capacitor to bring the second capacitor to a fourth voltage to adjust the rate of flow of charge through the variable current source, and the first capacitor is recharged to the first voltage. The rate of flow of charge through the variable current source controls the supply of current to the application.

18 Claims, 8 Drawing Sheets

SWITCHED CAPACITOR CURRENT SOURCE FOR USE IN SWITCHING REGULATORS

BACKGROUND

The present invention relates generally to voltage regulators, and more particularly to control systems for switching voltage regulators.

Voltage regulators, such as DC to DC converters, are used to provide stable voltage sources for electronic systems. Efficient DC to DC converters are particularly needed for battery management in low power devices, such as laptop notebooks and cellular phones. Switching voltage regulators (or simply "switching regulators") are known to be an efficient type of DC to DC converter. The switching regulator generates an output voltage by converting an input DC voltage into a high frequency voltage, and filtering the high frequency input voltage to generate the output DC voltage. Specifically, the switching regulator includes a switch for alternately coupling and de-coupling an unregulated input DC voltage source, such as a battery, to a load, such as an integrated circuit. An output filter, typically including an inductor and a capacitor, is coupled between the input voltage source and the load to filter the output of the switch and thus provide the output DC voltage. The switch is typically controlled by a pulse modulator, such as a pulse width modulator or a pulse frequency modulator. A feedback system generates a control signal which controls the duty cycle of the pulse modulator in order to maintain the output voltage at a substantially uniform level.

In many conventional switching regulators, the control signal generated by the feedback circuit is a control voltage. The control voltage is compared to a ramp voltage, such as a sawtooth voltage waveform generated by a ramp generator. When the control voltage exceeds the ramp voltage, the switch is closed to connect the voltage source to the load, whereas if the control voltage is lower than the ramp voltage, the switch is opened to disconnect the voltage source from the load.

The gain of a pulse modulator is the ratio between the control voltage and the average output voltage. Thus, the gain, A, is approximately equal to:

$$A = \frac{V_{OUT}}{V_{CONTROL}} \tag{1}$$

where $V_{OUT}$ is the average output voltage and $V_{CONTROL}$ is the control voltage. If this gain is not constant, the feedback system will not be stable, the gain of the pulse modulator will vary, and the output voltage will not be substantially uniform.

SUMMARY

In one aspect, the invention is directed to a voltage regulator having an input terminal to be coupled to an input voltage source at an input voltage and an output terminal to be coupled to a load. The voltage regulator has a power switch to alternately couple and decouple the input terminal to the output terminal with a switching frequency and a variable duty cycle, a filter disposed between the input terminal and the output terminal to provide a substantially DC voltage at the output terminal, a feedback circuit to measure an electrical characteristic of the voltage regulator and generate a control signal for maintaining the DC voltage at a substantially constant level. A ramp voltage generator including a ramp capacitor having a capacitance generates a ramp voltage, and a current supply coupled to the ramp voltage generator for controlling a current to the ramp capacitor causes the current to be proportional to the input voltage, the capacitance of the ramp capacitor, and the switching frequency. A comparator compares the ramp voltage to the control signal and generates an output signal to control the power switch.

Implementation of the invention may include the following. The current supply may include a first capacitor and a variable current source and be configured to charge the first capacitor with a first amount of charge which is proportional to the input voltage and the capacitance of the ramp capacitor and to discharge a second amount of charge from the first capacitor through the variable current source which is proportional to the switching period. The current supply may be configured such that the first amount of charge is substantially equal to the second amount of charge. A rate of flow of charge through the variable current source may control the current to the ramp capacitor.

In another aspect, the invention is directed to a current supply for supplying a current to an application. The current supply has a first switch connecting a voltage source to a node, a first capacitor connecting the node to ground, a variable current source to control the current to the application, a second switch connecting the node to the variable current source, a second capacitor, the charge across the second capacitor controlling the variable current source, and a third switch connecting the node to the second capacitor.

Implementations of the invention may include the following. The current may be positive or negative and flows into or out of the application. A controller may control the first, second and third switches, and may be configured to provide a first mode in which the first switch is closed and the second and third switches are open, a second mode in which the second switch is closed and the first and third switches are open, and a third mode in which the second switch is closed and the first and second switches are open. An output of the variable current source may be connected directly to the application, or a current mirror may connect an output of the variable current source to the application, or a fourth switch may connect the application to a second node in the current supply located between the second switch and the variable current source. An integrator including an op-amp and the second capacitor connected in parallel may couple the third switch to a control input for the variable current source. The variable current source may includes a transistor having a gate connected to the second capacitor.

In another aspect, the invention is directed to a method of operating a current supply connected to an application. In the method, a first capacitor is charged to a first voltage, the first capacitor is discharged to a second voltage through a variable current source at a rate which is controlled by a third voltage on a second capacitor, the first capacitor is connected to the second capacitor to bring the second capacitor to a fourth voltage to adjust the rate of flow of charge through the variable current source, and the first capacitor is recharged to the first voltage. The rate of flow of charge through the variable current source controls the supply of current to the application.

Implementations of the invention may include the following. The flow of charge through the variable current supply may provide the current for the application, or the application may be connected through the variable current source to ground, or the flow of charge through the variable current source may be mirrored with a current mirror to supply current to the application. The second voltage may be substantially at ground.

The advantages of the invention may include the following. The pulse modulator has a stable gain so that the output voltage is maintained at a substantially uniform level. The pulse modulator may be implemented using switched-capacitor based circuitry, and may be fabricated using conventional processes suitable for complimentary metal oxide semiconductor (CMOS) fabrication techniques. The gain is well controlled and is sensitive to process variations and other sources of mismatch.

DETAILED DESCRIPTION

Figure 1:
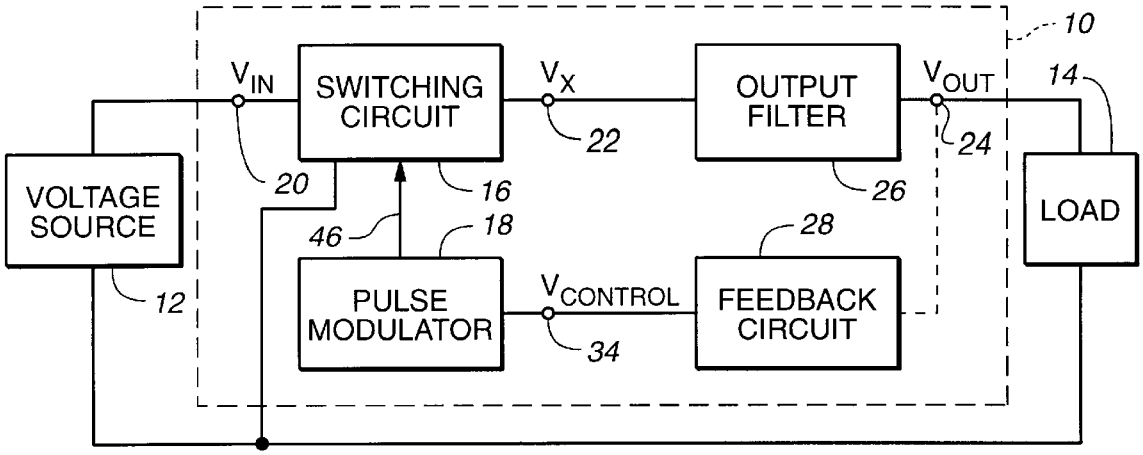
FIG. 1 is a block diagram of a switching regulator in accordance with the present invention.

Referring to FIG. 1, a switching regulator 10 is coupled to an unregulated DC input voltage source 12, such as a battery, by an input terminal 20. The switching regulator 10 is also coupled to a load 14, such as an integrated circuit, by an output terminal 24. The switching regulator 10 serves as a DC to DC converter between the input terminal 20 and the output terminal 24. The switching regulator 10 includes a switching circuit 16 which serves as a power switch for alternately coupling and de-coupling the input terminal 20 to an intermediate terminal 22. The switching regulator also includes a pulse modulator 18 for controlling the operation of the switching circuit 16. The pulse modulator 18 causes the switching circuit 16 to convert the substantially DC input voltage $V_{IN}$ at the input terminal 20 into an intermediate voltage having a rectangular waveform at the intermediate terminal 22. Although the pulse modulator 18 will be illustrated and described below as a pulse width modulator, the invention is also applicable to various pulse frequency modulation schemes. The intermediate terminal 22 is coupled to the output terminal 24 by an output filter 26. The output filter 26 converts the rectangular waveform at the intermediate terminal 22 to a substantially DC output voltage $V_{OUT}$ at the output terminal 24. The switching circuit 16 and the output filter 26 may have a buck converter topology as illustrated in FIG. 1, or another topology, such as a boost converter or buck-booster converter topology.

The output voltage is regulated, or maintained at a substantially constant level, by a feedback circuit 28. The feedback circuit 28 measures electrical properties of the output, such as output voltage and/or output current, and generates a control voltage $V_{CONTROL}$ on a duty cycle control line 34 to control the pulse modulator 18. The pulse modulator 18 may constructed almost entirely of switched capacitor based components, so that most of the switching regulator may be implemented or fabricated on a single chip utilizing conventional CMOS techniques and with a reduced number of discrete (off-chip) circuits.

Figure 2A:
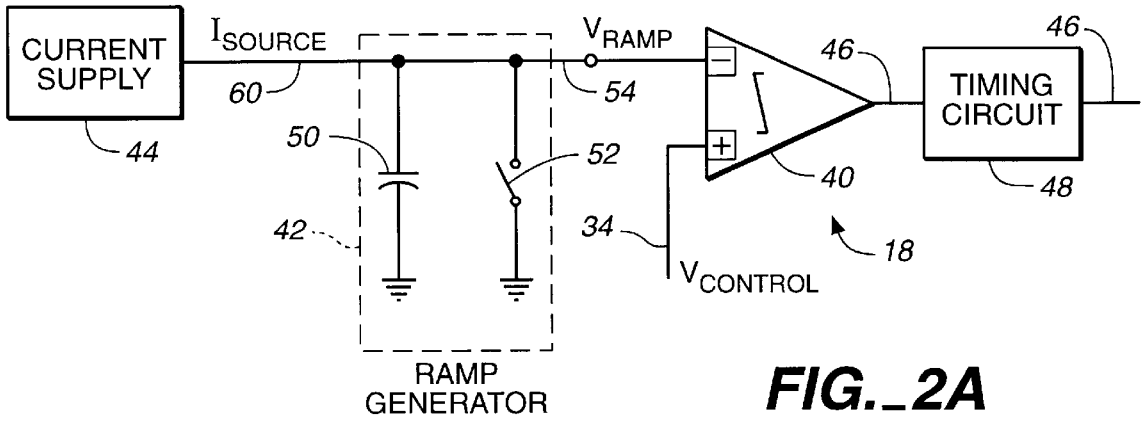
FIG. 2A is a schematic circuit diagram of one embodiment of the pulse modulator from Figure.
Figure 3:
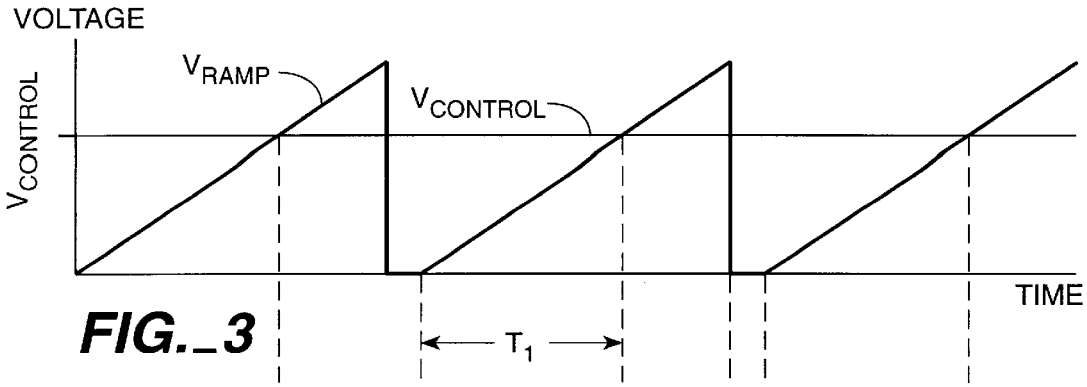
FIG. 3 is a timing diagram showing the ramp voltage and the control voltage of the pulse modulator.

Referring to FIG. 2A, the pulse modulator 18 includes a comparator 40, a ramp generator 42, and a current supply 44. The ramp generator 42 includes a ramp capacitor 50 and a ramp switch 52 connected in parallel between the current supply 44 and ground. In operation, current from the current supply 44 charges the ramp capacitor 50 to generate a linearly increasing voltage $V_{RAMP}$ across the ramp capacitor 50. The ramp switch 52 is closed at a frequency $F_S$ to discharge the ramp capacitor 50 back to ground. Referring to FIG. 3, the output voltage from the ramp generator 42 is a sawtooth wave having a frequency $F_S=1/T_S$.

Returning to FIG. 2A, a top plate of the ramp capacitor 50 is connected to a negative input of the comparator 40 by a ramp line 54, and the control line 34 is connected to a positive input of the comparator 40. The comparator 40 compares the control voltage $V_{CONTROL}$ on the control line 34 to the ramp voltage $V_{RAMP}$ on the ramp line 54, and outputs a high voltage on a timing line 46 if $V_{CONTROL}$ is greater than $V_{RAMP}$, and a low voltage on the timing line 46 if $V_{CONTROL}$ is less than $V_{RAMP}$. The voltage on the timing line 46 may be used to directly control the switching circuit, or it may trigger a more complex timing circuit 48 which generates signals to control all the switches in the voltage regulator. The timing circuit 48 may include an oscillator to generate a signal with a regular period $T_S$ and a frequency $F_S$. Specifically, the timing circuit 48 may close the switching circuit to connect the input voltage source to the intermediate terminal at regular interval $T_S$, and couple the intermediate terminal to ground when the ramp voltage $V_{RAMP}$ exceeds the control voltage $V_{CONTROL}$.

Figure 4:
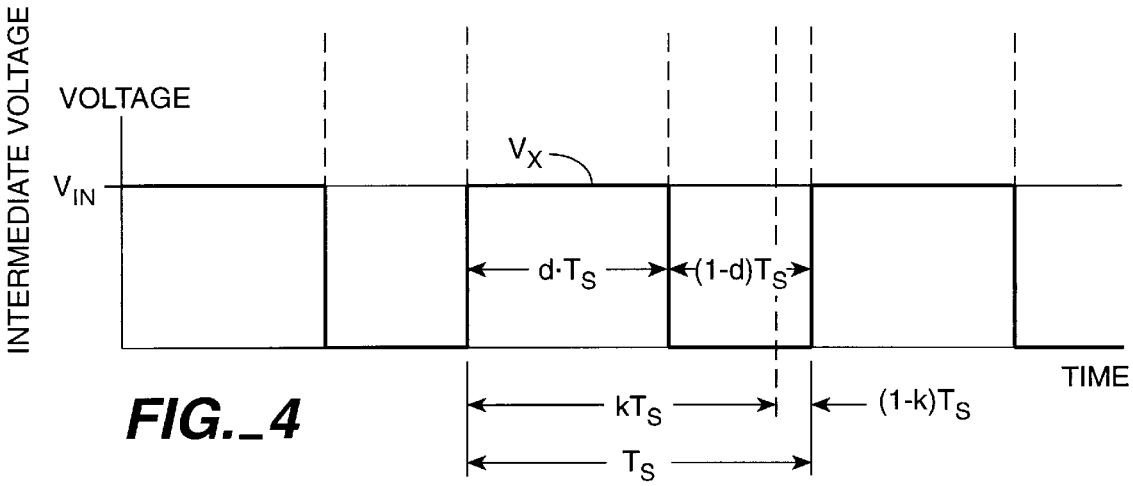
FIG. 4 is a timing diagram showing the intermediate voltage an the intermediate terminal in the switching regulator of FIG. 1.

Referring to FIG. 4, the resulting intermediate voltage $V_X$ at the intermediate terminal is a rectangular waveform having a constant frequency $F_S=1/T_S$ and a variable duty cycle d (the percentage of the cycle in which the intermediate terminal is connected to the input terminal). The frequency $F_S$ of the switching voltage may be in the range of about 10 kilohertz to several megahertz. In the rectangular waveform, the intermediate voltage has a maximum value equal to the input voltage $V_{IN}$.

The duty cycle, d, is determined by the time, $T_1$, required for the ramp voltage $V_{RAMP}$ to exceed the control voltage $V_{CONTROL}$. This time, $T_1$, is equal to the time required for the ramp capacitor 50 to be charged to the control voltage $V_{CONTROL}$. Assuming that charge flows into the ramp capacitor 50 from the current supply 44 at a constant rate $I_{SOURCE}$, $$I_{SOURCE} \cdot T_1 = V_{CONTROL} \cdot C_{RAMP} \qquad V_{CONTROL} = \frac{I_{SOURCE} \cdot T_1}{C_{RAMP}} \tag{2}$$

where $C_{RAMP}$ is the capacitance of the ramp capacitor 50.

The average voltage $V_{OUT}$ is approximately equal to the product of the input voltage $V_{IN}$ and the duty cycle d, i.e., $V_{OUT}=d\times V_{IN}$. Because $d=T_1/T_S$, the average voltage $V_{OUT}$ may be expressed by the following equation:

$$V_{OUT} = d \cdot V_{IN} = \frac{T_1 \cdot V_{IN}}{T_S} \tag{3}$$

As previously noted in Equation (1), the gain of the pulse modulator 18 is the ratio of the average voltage $V_{OUT}$ to the control voltage $V_{CONTROL}$. By substituting Equations (2) and (3) into Equation (1), the gain A is given by the following equation:

$$A = \frac{V_{IN} \cdot C_{RAMP}}{I_{SOURCE} \cdot T_S} = \frac{V_{IN} \cdot C_{RAMP} \cdot F_S}{I_{SOURCE}} \tag{4}$$

As previously discussed, and referring to FIGS. 1 and 2A, it is desirable for the gain of the pulse modulator 18 to be constant so that the switching regulator and feedback control circuit 28 are stable. The input voltage $V_{IN}$ is determined by the voltage source 12, the capacitance $C_{RAMP}$ value of the ramp capacitor 50 is determined by the layout of the circuit and the fabrication process, and the operation frequency $F_S$ is determined by the timing circuits. Since these operating parameters may drift over time (e.g., if the temperature of the switching regulator or the input voltage changes), the gain of the pulse modulator may also drift. However, the pulse modulator 18 is constructed so that the current $I_{SOURCE}$ from the current supply 44 provides a constant gain. Specifically, the current $I_{SOURCE}$ is proportional to the input voltage $V_{IN}$, the operating frequency $F_S$, and the capacitance $C_{RAMP}$ of the ramp capacitor. Thus, the gain of the pulse modulator 18 is constant even if the values of $V_{IN}$, $F_S$ and $C_{RAMP}$ drift or are unknown.

Figure 2B:
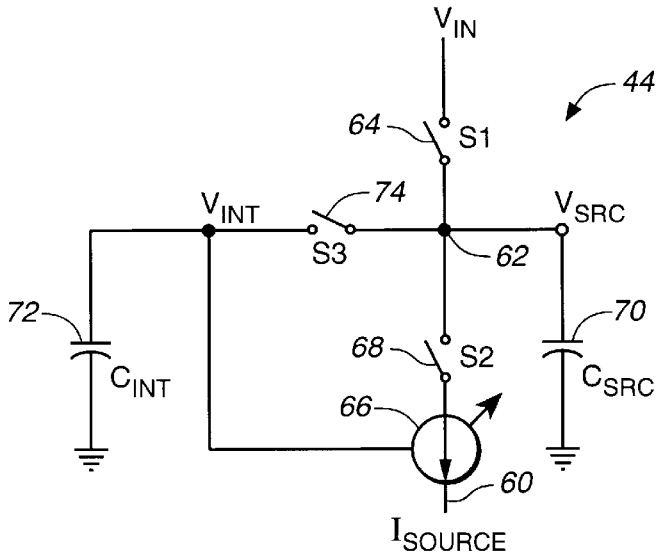
FIG. 2B is a schematic circuit diagram of one embodiment of a current supply.

Referring to FIG. 2B, to implement the current supply 44, the input voltage $V_{IN}$ is connected to a central node 62 by a first switch "S1" 64. The central node 62 is connected, in turn, to a variable current source 66 by a second switch "S2" 68. An output line 60 from the variable current source 66 provides the source current $I_{SOURCE}$ for the ramp generator 42 (see FIG. 2A). The central node 62 is connected to ground by a source capacitor 70, and is also connected to a top plate of an intermediate capacitor 72 by a third switch "S3" 74. The bottom plate of the intermediate capacitor 72 may be connected to ground. The source capacitor 70 has a capacitance $C_{SRC}$, whereas the intermediate capacitor 72 has a capacitance $C_{INT}$. The voltage, $V_{INT}$, at the top plate of the intermediate capacitor 72 controls the rate at which charge flows through the variable current source 66. The variable current source 66 may be a vacuum tube or a transistor, e.g., a MOSFET device, such as an NMOS transistor, having its gate connected to the intermediate capacitor 72, or a more complex circuit, such as a cascode or a Widlar. As will be described in greater detail below, the current supply 44 generates an output current $I_{SOURCE}$ on output line 60 which is proportional to the input voltage $V_{IN}$, the operating frequency $F_S$, and the capacitance $C_{RAMP}$ of the ramp capacitor. This improves the uniformity of the gain of the pulse modulator 18 and thus the uniformity of output voltage.

Figure 5:
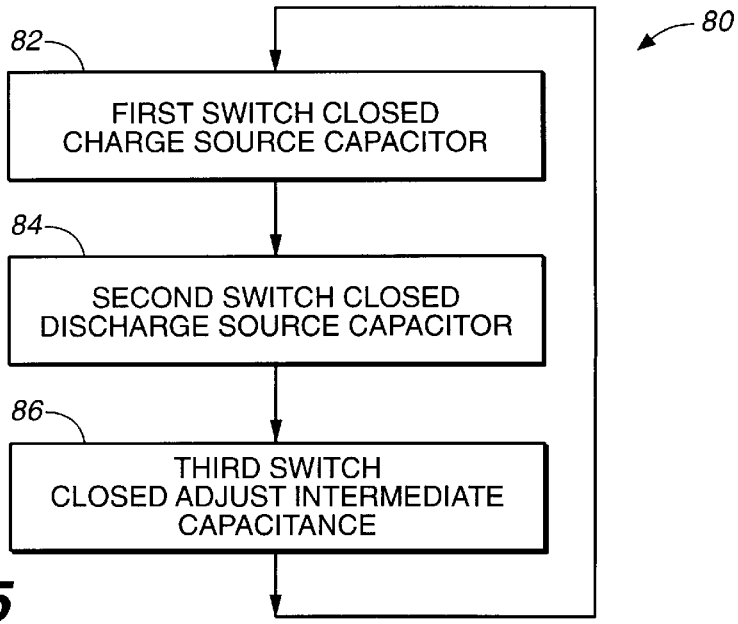
FIG. 5 is a flow diagram of a method of operating the current supply of FIG. 2B.

Referring to FIGS. 2B, 3 and 5, a method 80 of operating the current supply 44 is illustrated. Initially, the second and third switches 68 and 74 are open, and the first switch 64 is closed to couple the source capacitor 70 to the input voltage source and thus charge the source capacitor 70 to the input voltage $V_{IN}$ (charging step 82). Then the first switch 64 is opened, and the second switch 68 is closed for a specified interval which is a set percentage, e.g., k, of the period $T_S$ (discharge step 84). Thus, this interval has a duration of $kT_S$. The percentage k may be set to be 75% to 90% of the period $T_S$ by using the same clock or timing circuit that drives the ramp switch 52. The beginning of the discharge step may be aligned by the timing circuit to coincide with the beginning of each period $T_S$. During this interval $kT_S$, current flows from the source capacitor 70 through the variable current source 66 to provide the source current to the ramp generator 42. Then the second switch 68 is opened, and the third switch 74 is closed (adjustment step 86). This redistributes the charge between the intermediate capacitor 72 and the source capacitor 70 so that the voltage across the two capacitors is equal. Finally, the third switch 74 is opened and the first switch 64 is closed to recommence the charging step 82. The charging step 82 and the adjustment step 86 result in a "dead time" having a combined duration of $(1-k)T_S$ during which the ramp capacitor is not being charged.

The voltage $V_{INT}$ on the intermediate capacitor 72 is adjusted during the adjustment step to set the flow of current through the variable current source 66 during the next discharge step. Specifically, if the voltage $V_{SRC}$ on the source capacitor 70 is less than the voltage $V_{INT}$, then during the adjustment step 86 charge will flow from the source capacitor 70 to the intermediate capacitor 72, thereby increasing the intermediate voltage $V_{INT}$ and increasing the rate of flow of charge through the variable current source 66. On the other hand, if the source voltage $V_{SRC}$ is higher than the intermediate voltage $V_{INT}$, then during the adjustment step 86 charge will flow from the intermediate capacitor 72 to the source capacitor 70, thereby decreasing the intermediate voltage $V_{INT}$ and decreasing the rate of flow of charge through the variable current source 66. Consequently, if $I_{SOURCE}$ is large, then sufficient charge will be drained from the source capacitor 70 during the discharge step so that $V_{SRC}$ will be less than $V_{INT}$. This will cause $V_{INT}$ to drop during the adjustment step, thus decreasing $I_{SOURCE}$ in the next discharge step. On the other hand, if $I_{SOURCE}$ is small, insufficient charge will be drained from the source capacitor during the discharge step, and $V_{SRC}$ will be larger than $V_{IN}$, causing $V_{INT}$ to rise during the adjustment step, and thus increasing $I_{SOURCE}$ in the next discharge step.

This automatic feedback causes the current $I_{SOURCE}$ to reach an equilibrium in which, at the end of each discharge step, the source voltage $V_{SRC}$ is equal to the intermediate voltage $V_{INT}$, and the charge drained from the source capacitor in the discharge step is equal to the charge placed on the source capacitor during the charging step. Since the charge which accumulates on the source capacitor 70 in the charging step 82 is equal to $(V_{IN}-V_{EQ})\times C_{SRC}$, where $V_{EQ}$ is the equilibrium voltage of the source capacitor at the beginning of the charging step, and the charge that is drained from the source capacitor 70 during the discharge step 84 is equal to $kT_S \cdot I_{SOURCE}$, $$(V_{IN}-V_{EQ})\cdot C_{SRC}=kT_S\cdot I_{SOURCE} \quad (5)$$

The current supply 44 may be designed, by selecting an appropriate variable current source and appropriate capacitances for the source and intermediate capacitor, so that the equilibrium voltage goes to ground, i.e., $V_{EQ}=0$. Consequently, the steady state value for the current $I_{SOURCE}$ on the output line 60 may be given by the following equation:

$$I_{SOURCE} = \frac{V_{IN}\cdot C_{SRC}}{kT_S} = \frac{V_{IN}\cdot C_{SRC}\cdot F_S}{k} \quad (6)$$

Assuming that the source capacitor 70 and the ramp capacitor are fabricated with a similar structure and using the same process, they should have about the same capacitance. Therefore, the current from the current supply 44 will be proportional to the input voltage $V_{IN}$, the operating frequency $F_S$, and the capacitance $C_{RAMP}$ of the ramp capacitor. Consequently, even if $V_{IN}$, $C_{RAMP}$ and $F_S$ drift or are unknown, the gain of the pulse modulator will be constant, and the switching regulator will be stable.

Referring to FIG. 2A, it may be noted that the electrical "polarity" of the pulse modulator 18 could be reversed, with the ramp capacitor 50 and the ramp switch 52 connected to the control voltage, and the positive input of the comparator 40 connected to ground. In this case, the current supply 44 is designed so that charge will drain out the ramp capacitor 50 through the variable current source.

Figure 6:
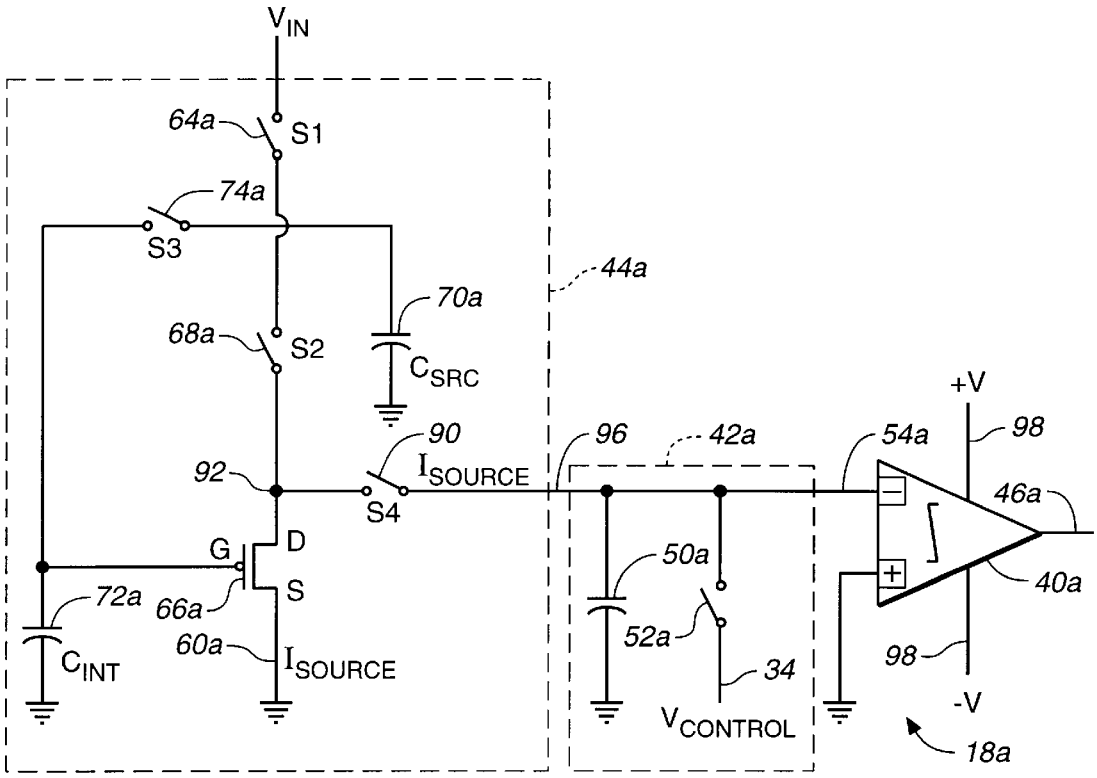
FIG. 6 is a schematic circuit diagram of a current supply in which the current flows through a fourth switch.

Referring to FIG. 6, in another embodiment of the pulse modulator 18*a*, the variable current source 66*a* serves to regulate the flow of current out of the ramp generator 42*a*. The ramp generator includes a ramp capacitor 50*a* and a ramp switch 52*a*. The control line 34 is connected to the top plate of the ramp capacitor 50*a* and to one input of the comparator 40*a* by ramp switch 52*a*. The other input of the comparator 40*a* is connected to ground. The bottom plate of the ramp capacitor 50*a* may be connected to ground. The ramp capacitor 50*a* and the ramp switch 52*a* are also connected to the input voltage source 44*a*. In operation, the ramp switch 52*a* is periodically closed (at a frequency $F_S$) to charge it up to the control voltage $V_{CONTROL}$. Then charge is drained from the ramp capacitor 50*a* through the variable current source 66*a* to generate a linearly decreasing ramp voltage $V_{RAMP}$ on the ramp line 54*a*. This embodiment is primarily illustrative, although it could be implemented if comparator 40*a* was provided with positive negative supply rails 98.

The current supply 44*a* is similar in construction to the current supply 44 (see FIG. 2B), with three switches 64*a*, 68*a* and 74*a*, a source capacitor 70*a*, an intermediate capacitor 72*a*, and a variable current source 66*a* which is controlled by the voltage across the intermediate capacitor 72*a*. The variable current source 66 may be a NMOS transistor having its gate connected to the intermediate capacitor 72*a*, its source connected to ground, and its drain connected to the second switch 68*a*. However, the current supply 44*a* also includes a fourth switch "S4" 90 that connects a node 92 in the circuit path between the second switch 68*a* and the variable current source 66*a* to a current drain line 96. The fourth switch 90 may be closed any time that the second switch 68*a* is open. For example, the fourth switch 90 may be closed during the charging and adjustment steps 82 and 86 (FIG. 5), respectively. Thus, during these two steps, current flows out of the ramp generator 42*a* through the variable current source 66*a* at a rate $I_{SOURCE}$ which has been determined by the charge on intermediate capacitor 72*a*. Thus, in this embodiment, the discharge step 84 (FIG. 5) results in a "dead time" having a duration of $kT_S$ during which the ramp capacitor is not being charged, whereas the charging and adjustment steps 82 and 86 have a combined duration $(1\text{-}k)T_S$ during which the ramp capacitor is being charged. In this embodiment, the percentage k may be set to about 10% to 25% of the period $T_S$.

Alternately, there may be a connection step between the discharge and adjustment steps 84 and 86, respectively. In this connection step, the first, second and third switches 64*a*, 68*a* and 74*a* are open, and the fourth switch 90 is closed to connect the ramp generator 42*a* to the variable current source 66*a*. The duration of the connection step should be at least about 75% of the period $T_S$.

Figure 7:
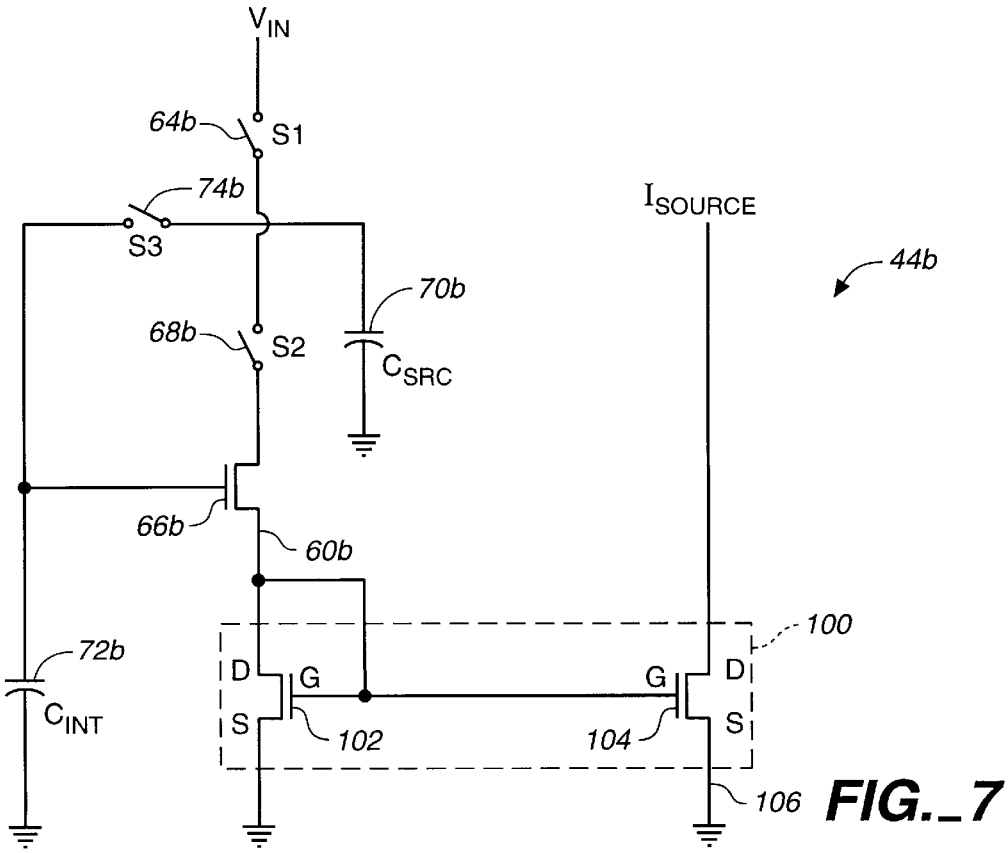
FIG. 7 is a schematic circuit diagram of a current supply in which the variable current regulator is mirrored.

Referring to FIG. 7, in another embodiment, the current supply 44*b* supplies current to the ramp generator with a current mirror 100. The current supply 44*b* is similar in construction to the current supply 44 (FIG. 2B), with three switches 64*b*, 68*b* and 74*b*, a source capacitor 70*b*, an intermediate capacitor 72*b*, and a variable current source 66*b* which is controlled by the voltage across the intermediate capacitor 72*b*. The current on the output line 60*b* from the variable current source 66*b* is mirrored with the current mirror 100. The current mirror 100 includes a first transistor 102 and a second transistor 104. The first transistor 102 has its drain and gate connected to the variable current source 66*b* and its source connected to ground. The second transistor 104 has its source connected to ground, its drain connected to the ramp generator by a ramp current line 106, and its gate connected to the variable current source 66*b*. Since the current flowing through the first transistor 102 is set by the variable current source, and the same voltage is across the gates and sources of both transistors, the current flowing through the second transistor 104 to the ramp generator must mirror the current flowing through the first transistor 102. Furthermore, current may flow continuously through the second transistor 104, independent of the status of switches 64*b*, 68*b*, and 74*b*, thereby eliminating the "dead time" $(1\text{-}k)T_S$ from the ramp voltage waveform shown in FIG. 3.

Figure 8:
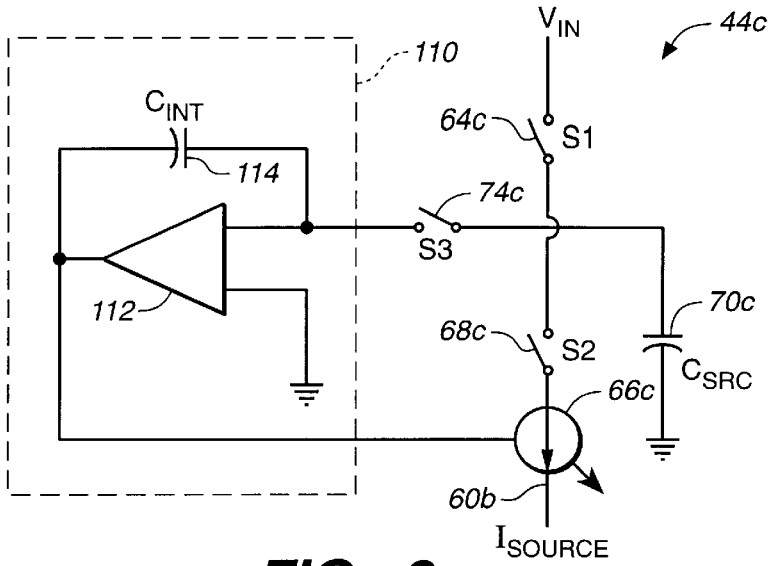
FIG. 8 is a schematic circuit diagram of a current supply that includes an integrator.

Referring to FIG. 8, in another embodiment, the current supply 44*c* includes an integrator 110 for controlling the variable current source 66*c*. The current supply 44*c* is similar in construction to the current supply 44 (FIG. 2B), with three switches 64*c*, 68*c* and 74*c*, a source capacitor 70*c*, and a variable current source 66*c*. However, the third switch 74*c* is connected to an integrator 110, and the output of the integrator 110 controls the variable current source 66*c*. The integrator 110 includes an op-amp 112 and an integrating capacitor 114. One input of the op-amp 112 is connected to the third switch 74*c* and to the top plate of the integrating capacitor 114, whereas the other input of the op-amp 112 is connected to ground. The output of the op-amp 112 is connected to the bottom plate of the integrating capacitor 114 and to the variable current source 66*c*. Because the voltages at the two inputs of an op-amp must be equal in the steady state, the source capacitor 70*c* will be drained or charged to ground by the end of the adjustment step. Thus, any charge remaining on the source capacitor 70*c* at the end of the discharge step will be shifted onto the integrating capacitor 114 during the adjustment step, thereby setting the voltage applied to the variable current source 66*c*. The variable current source 66*c* will decrease the output current in response to an increase in the integrator voltage $V_{INT}$ and increase the output current in response to a decrease in the integration voltage $V_{INT}$. For example, the variable current source 66*c* may be an NMOS transistor.

Figure 9:
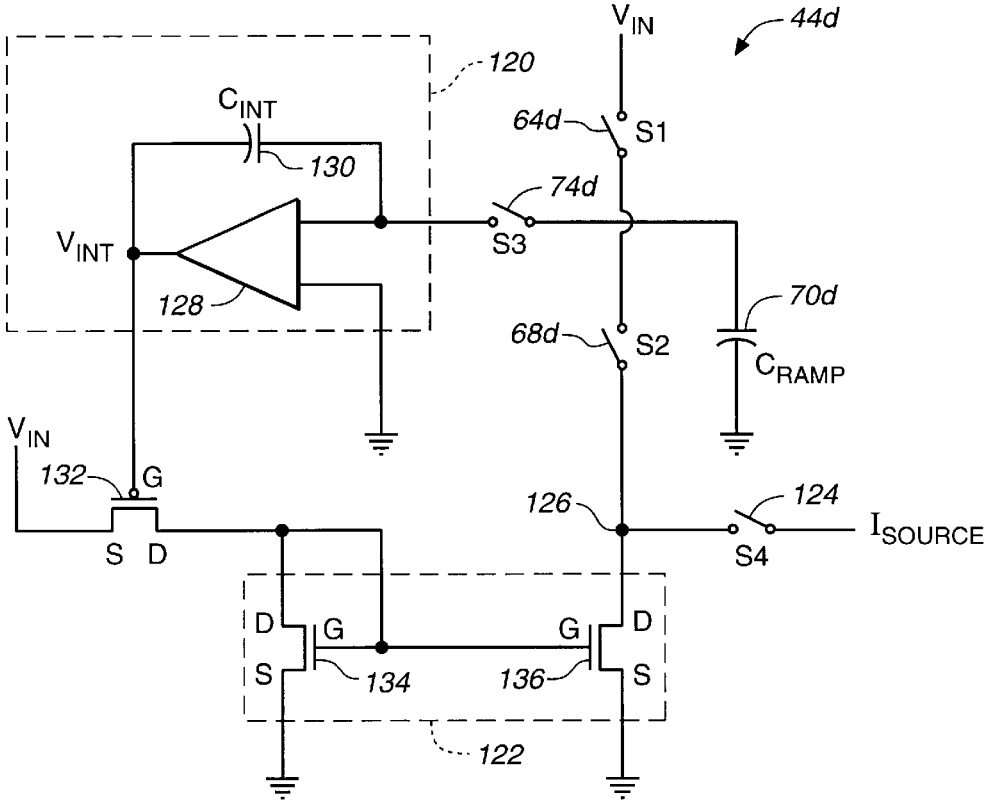
FIG. 9 is a schematic circuit diagram of a current supply that includes an integrator, a current mirror, and a fourth switch to connect the current supply to an application.

Referring to FIG. 9, in anther embodiment, the current supply 44*d* includes an integrator 120, a current mirror 122, and a fourth switch "S4" 124 to connect the current supply to an application. The current supply 44*d* is similar in construction to the current supplies shown in FIGS. 6–8, with three switches 64*d*, 68*d* and 74*d*, a source capacitor 70*d*, and a variable current source 66*d*. The fourth switch 124 connects the ramp generator to a node 126 between the variable current source 66*d* and the third switch 68*d*. The integrator 120 includes an op-amp 128 and an integrating capacitor 130. One input of the op-amp 128 is connected to the third switch 74*d* and to the top plate of the integrating capacitor, and the other input of the op-amp 128 is connected to ground. The output of the op-amp 128 is connected to the gate of a transistor 132 and to the bottom plate of the integrating capacitor 130. The source of the transistor 132 is connected to the input voltage. The drain of transistor 132 is connected to the current mirror 122. The current mirror 122 includes a first transistor 134 and a second transistor 136. The first transistor 134 has both its gate and drain connected to the drain of the first transistor, and its source connected to ground. The second transistor 136 has its drain connected to the second switch 68*d*, its source connected to ground, and its gate connected to the gate of the first transistor 134. Thus, the current flowing through transistor 132 is mirrored in the second transistor 134. The transistor 132 may be a PMOS device, whereas the first and second transistors 134 and 136 may be NMOS devices.

Figure 10:
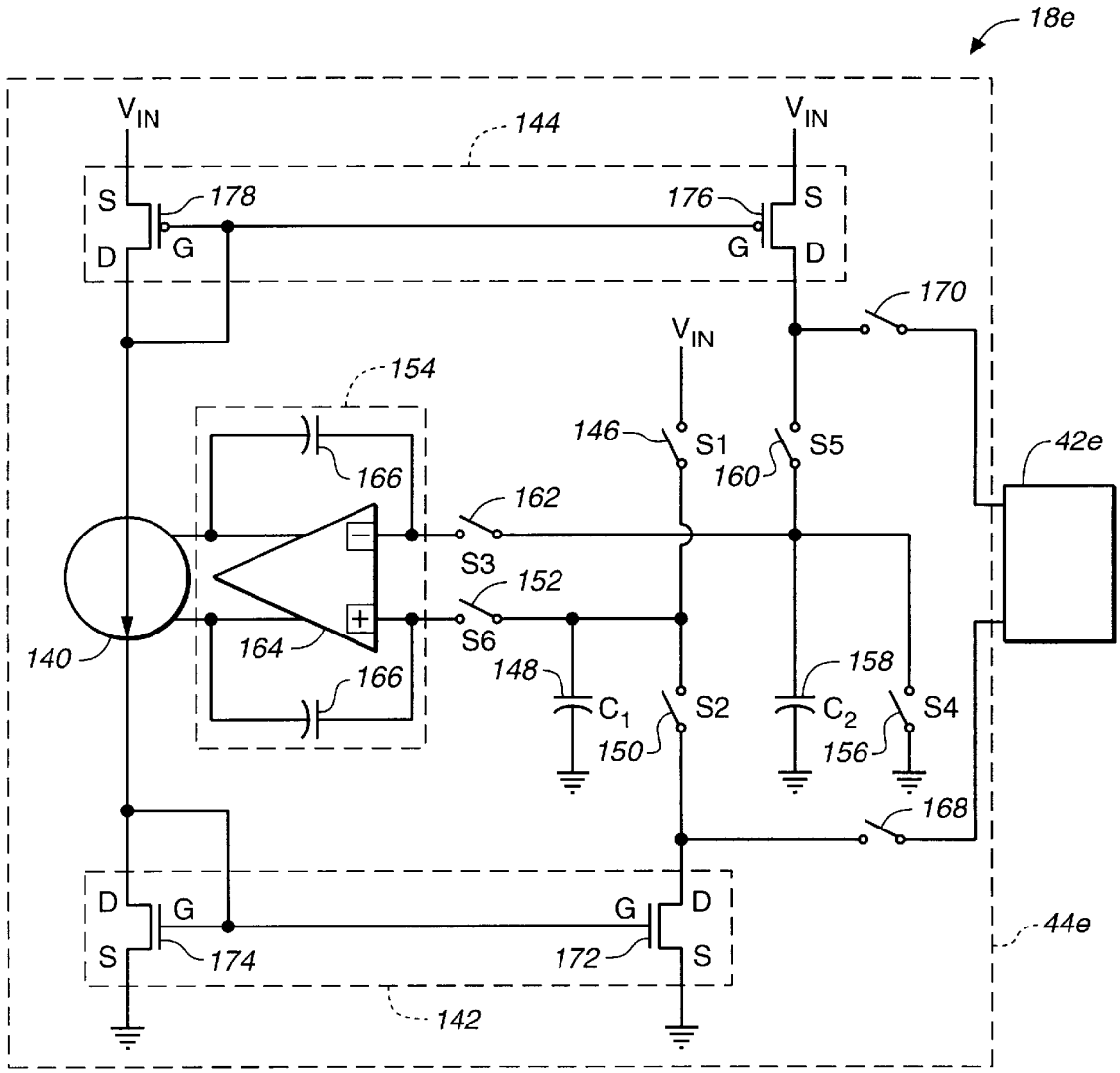
FIG. 10 is a schematic circuit diagram of a differential current supply that includes a differential integrator.

Referring to FIG. 10, in another embodiment, the current supply 44*e* may include a differential variable current source 140. The current supply 44*e* includes two current paths. The two current paths are linked to the current passing through the differential variable current source 140 by first and second current mirrors 142 and 144, respectively. The first current mirror 142 includes a first transistor 172 that connects the first current path to the ground and a second transistor 178 that connects the differential current regulator 140 to ground. The second current mirror 144 includes a first transistor 176 that connects the second current path to the input voltage and a second transistor 174 that connects the differential current regulator 140 to the input voltage. The transistors 172 and 174 in the first current mirror 142 may be NMOS transistors, whereas the transistors 176 and 178 in the second current mirror 144 may be PMOS transistors.

In the first current path, a first switch 146 connects the voltage source to a top plate of a first capacitor 148. The bottom plate of the capacitor may be connected to ground. A second switch 150 connects the top plate of the first capacitor 148 to another transistor 172 in the first current mirror 142. A third switch 152 connects the top plate of the first capacitor 148 to one input of a differential integrator 154. In the other current path, a fourth switch 156 connects a top plate of a second capacitor 158 to ground, whereas a fifth switch 160 connects the top plate of the second capacitor 158 to the second current mirror 144. Finally, a sixth switch 162 connects the top plate of the second capacitor 158 to the other input of the differential integrator 154. The outputs of the differential integrator 154 control the current flowing through the differential variable current source 140. The differential integrator 154 may be of conventional construction, with a differential op-amp 164 and two capacitors 166. A first current drain switch 168 may connect a node in the first current path between the first current mirror 142 and the second switch 150 to the ramp generator 42*e*. Similarly, a second current drain switch 170 may connect a node in the second current path between the second current mirror 144 and the fifth switch 160 to the ramp generator 42*e*.

In operation, during the charging step, the first switch 146 and the fourth switch 156 are closed to charge to the first capacitor 148 to $V_{IN}$ and to drain the second capacitor 158 to ground, respectively. Then, in the discharge phase, the second switch 150 and the fifth switch 160 are closed so that charge will accumulate on the second capacitor 158 and will be drained from the first capacitor 148. The rate of current flow into the second capacitor 158 and out of the first capacitor 148 is controlled by the differential variable current source 140 via the current mirrors 152 and 154, respectively. Finally, in the adjustment step, the third switch 152 and the sixth switch 162 are closed to transfer the charge thereon into the differential integrator 154 and thereby tune the integrated voltage $V_{INT}$ and the source current $I_{SOURCE}$. In the steady state, when the third and sixth switches are closed, the voltages across the first and second capacitor should be the same. The first and second current drain switches 168 and 170 may be closed when the second and fifth switches 150 and 160 are open, respectively, to supply current to the ramp generator 42*e*.

Figure 11:
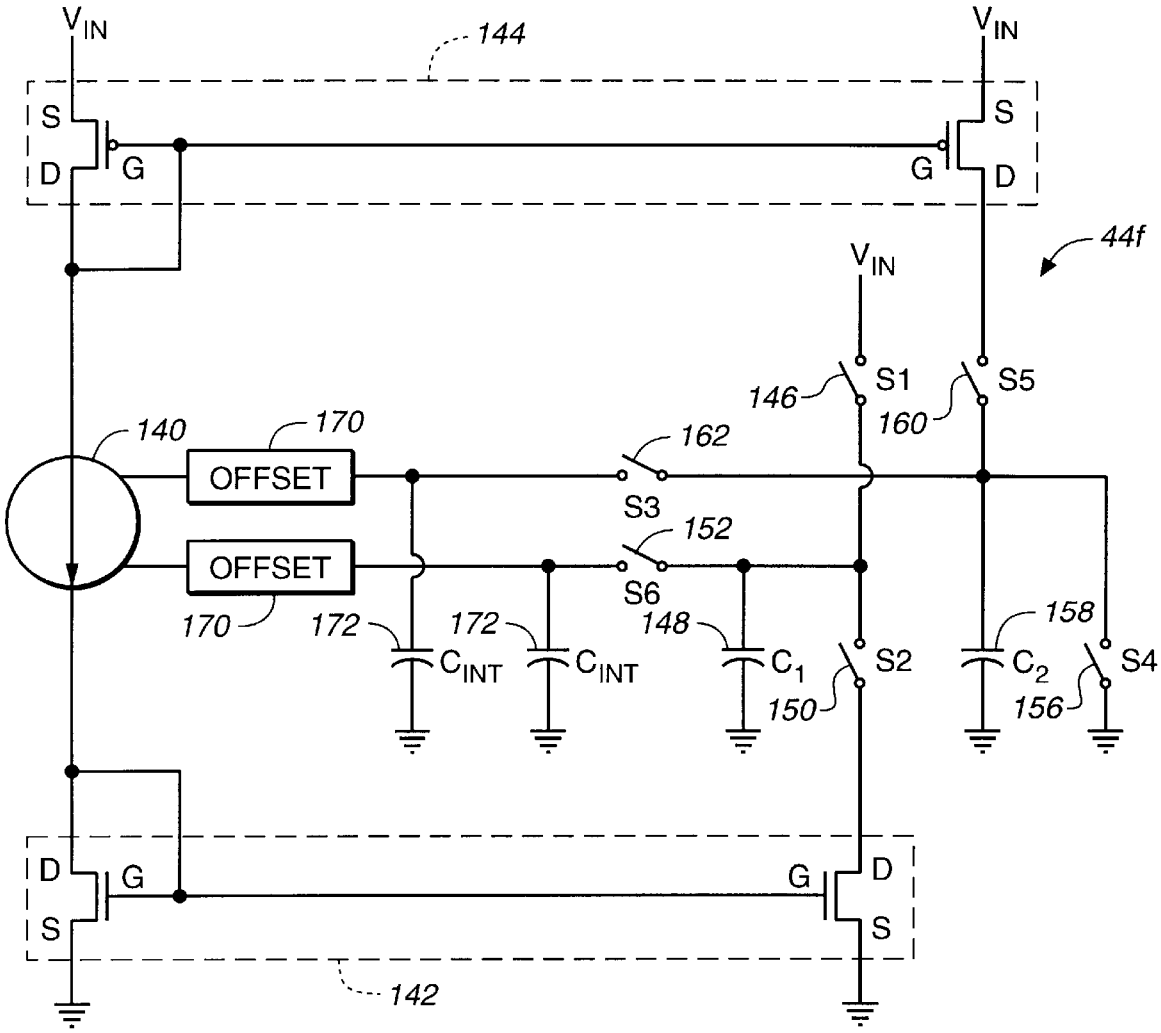
FIG. 11 is a schematic current diagram of a differential current supply that includes an offset voltage supply.

Referring to FIG. 11, in another embodiment, a current supply 44*f* is constructed similarly to current supply 44*e*, except that the differential integrator has been replaced by a combination of offset voltages 170 and integrating capacitors 172.

Figure 12:
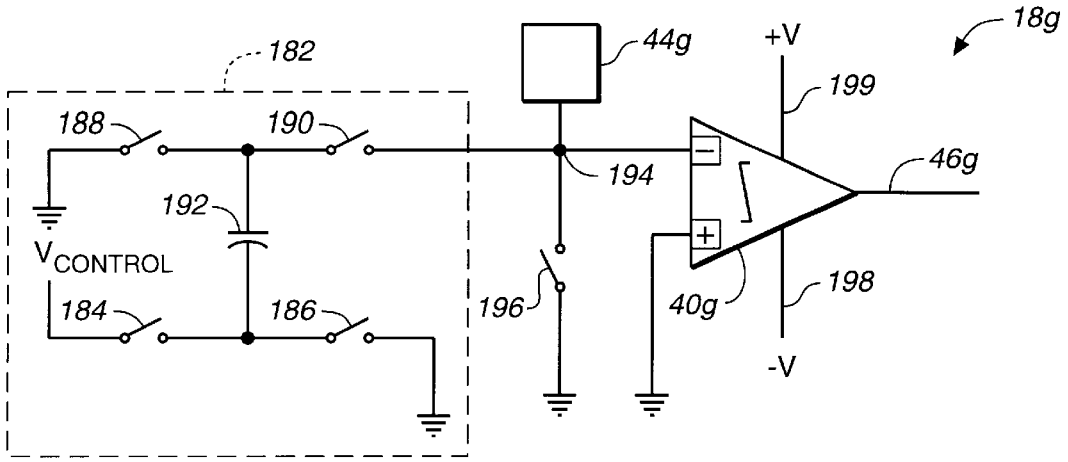
FIG. 12 is a schematic circuit diagram of a pulse modulator that includes a sampling circuit.

Referring to FIG. 12, in yet another embodiment, the pulse modulator 18*g* may include a comparator 40*g*, a current supply 44*g*, and a switched-capacitor based sampling circuit 182 to sample the control voltage $V_{CONTROL}$. This embodiment is also primarily illustrative, although it could be implemented if comparator 40*g* was provided with positive and negative supply rails 198. The sampling circuit 182 may provide a discrete-time sampling system for improved compatibility with digital circuitry. Discrete-time voltage and current sampling is discussed in greater depth in U.S. application Ser. No. 08/991,394, assigned to the assignee of the present invention, the entire disclosure of which is incorporated herein by reference. Since the sampling circuit 182 is constructed entirely of switches and capacitors, the sampling circuit can be implemented on the same chip as the remainder of the voltage regulator utilizing conventional CMOS techniques. The sampling circuit 182 includes four current sampling switches 184, 186, 188 and 190 and a sampling capacitor 192. The bottom plate of the sampling capacitor 192 is connected to the control line 34*g* by switch 184 and to ground by switch 186. The top plate of the sampling capacitor 192 is connected to ground by switch 188 and to the negative input of the comparator 40*g* by switch 190. The current supply 44*g* is connected to the negative input of the comparator 40*g*, and a switch 196 also connects the negative input of the comparator 40*g* to ground. The positive input of the comparator 40*g* is connected to ground. In operation, switches 184, 188 and 196 are closed while switches 186 and 190 are open. This simultaneously sets the voltage across the sampling capacitor 192 equal to the control voltage $V_{CONTROL}$, and resets the comparator 40*g*. Then, switches 186 and 190 are closed while switches 184, 188 and 196 are opened. This sets the voltage across the sampling capacitor 192 equal to the control voltage at the instant switches 184 and 188 were opened. In addition, this connects the sampling capacitor 192 to the input node of the comparator. Once switches 186 and 190 are closed, charge drains through the current supply 44*g* until the sampling capacitor 192 reaches ground and the comparator 40*g* is tripped.

Figure 13:
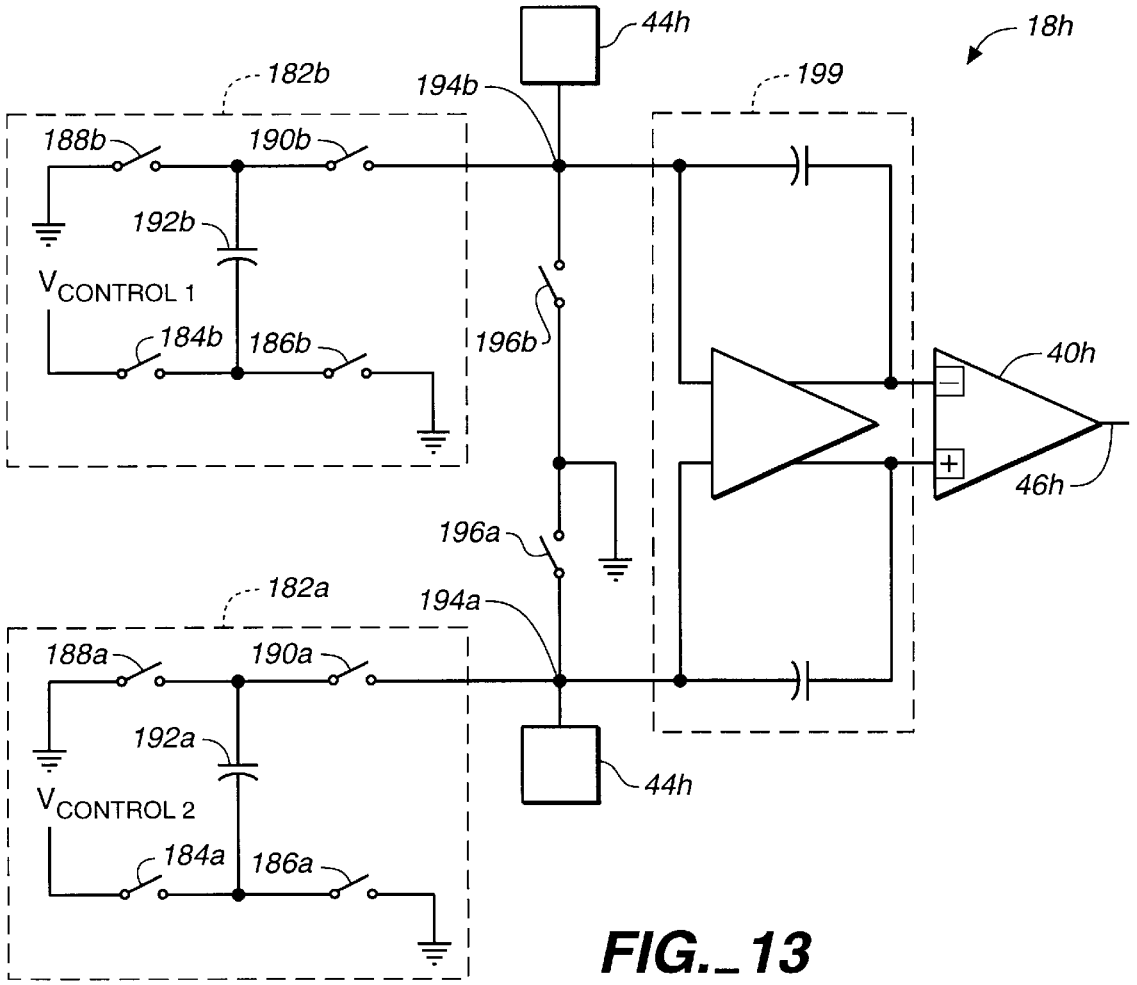
FIG. 13 is a schematic circuit diagram of a pulse modulator that includes two sampling circuits in a differential implantation.

Referring to FIG. 13, in still another embodiment, the pulse modulator includes two voltage sampling circuits 182*a* and 182*b* connected to a differential current supply 44*h* to provide a fully differential implantation in which the signal on the timing line 46*g* is based on the difference between a first control voltage $V_{CONTROL1}$ and a second control voltage $V_{CONTROL2}$. The sampling circuits 182*a* and 182*b* are constructed similarly to sampling circuit 182; the sampling circuit 182*a* includes four current sampling switches 184*a*, 186*a*, 188*a* and 190*a* and a sampling capacitor 192*a*, and the sampling circuit 182*b* similarly includes four current sampling switches 184*b*, 186*b*, 188*b* and 190*b* and a sampling capacitor 192*b*. The first sampling circuit 182*a* samples the first control voltage $V_{CONTROL1}$, and the second sampling circuit 182*b* samples the second control voltage $V_{CONTROL2}$. A first node 194*a* is connected to the positive current supply of differential current supply 44*h*, to sampling capacitors 192*a* by sampling switch 190*a*, to ground by a switch 196*a*, and to the positive input of the comparator 40*h*. Similarly, a second node 194*b* is connected to the negative current supply of differential current supply 44*h*, to sampling capacitors 192*b* by sampling switch 190*b*, to ground by a switch 196*b*, and to the negative input of the comparator 40*h*. An optional integrator 199 may be interposed between the first and second nodes 196*a* and 196*b*, and the comparator 40*h* to improve circuit performance.

Figure 14:
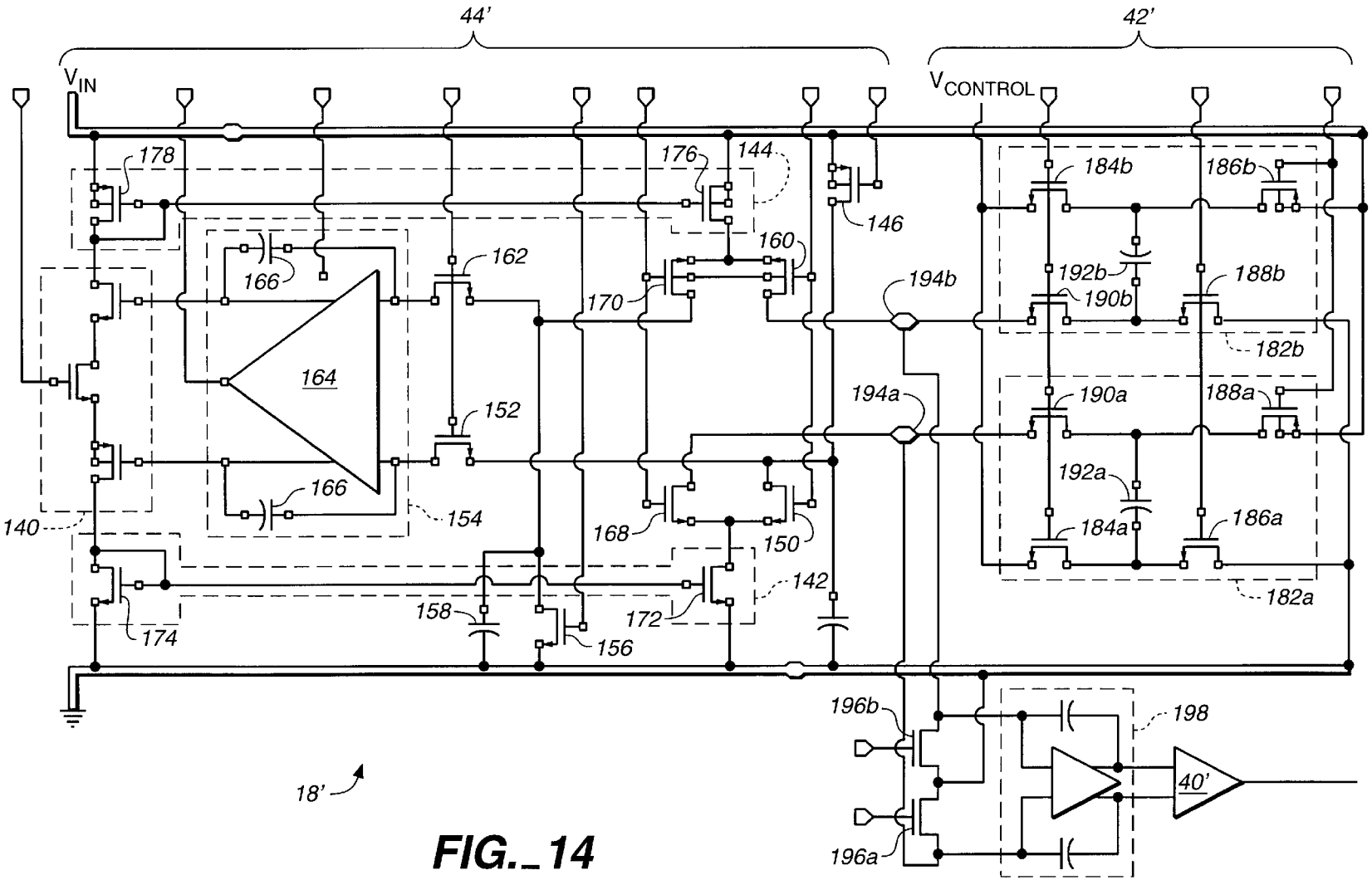
FIG. 14 is a schematic circuit diagram of even another embodiment of a pulse modulator that includes a differential current supply, a differential integrator, and a sampling circuit.

Referring to FIG. 14, in even another embodiment, the pulse modulator includes a differential current regulator 44', a ramp generator 42' with a two sampling circuits 182*a* and 182*b*, and switches 168 and 170 to connect the differential current regulator 44' to the ramp generator 42' and the comparator 40' at nodes 194*a* and 194*b*.

What is claimed is:

1. A voltage regulator having an input terminal to be coupled to an input voltage source at an input voltage and having an output terminal to be coupled to a load, comprising:

a power switch to alternately couple and decouple the input terminal to the output terminal with a switching frequency and a variable duty cycle;

a filter disposed between the input terminal and the output terminal to provide a substantially DC voltage at the output terminal;

a feedback circuit to measure an electrical characteristic of the voltage regulator and generate a control signal for maintaining the DC voltage at a substantially constant level;

a ramp voltage generator to generate a ramp voltage, the ramp voltage generator including a ramp capacitor having a capacitance;

a current supply coupled to the ramp voltage generator for controlling a current to the ramp capacitor, the current supply configured to cause the current flowing into the ramp voltage generator to be proportional to the input voltage, the capacitance of the ramp capacitor, and the switching frequency; and a comparator to compare the ramp voltage to the control signal and to generate an output signal to control the power switch.

2. The voltage regulator of claim 1, wherein the current supply includes a first capacitor and a variable current source, the current supply being configured to charge the first capacitor with a first amount of charge which is proportional to the input voltage and the capacitance of the ramp capacitor and to discharge a second amount of charge from the first capacitor through the variable current source which is proportional to the switching period, and the current supply is configured such that the first amount of charge is substantially equal to the second amount of charge.

3. The voltage regulator of claim 2, wherein a rate of flow of charge through the variable current source controls the current to the ramp capacitor.

4. A current supply for supplying a current to an application, comprising:

a first switch connecting a voltage source to a node;

a first capacitor connecting the node to ground;

a variable current source to control the current to the application;

a second switch connecting the node to the variable current source;

a second capacitor, the charge across the second capacitor controlling the variable current source; and a third switch connecting the node to the second capacitor.

5. The current supply of claim 4, wherein the current is positive and charge flows into the application.

6. The current supply of claim 4, wherein the current is negative and charge flows out of the application.

7. The current supply of claim 4, further comprising a controller to control the first, second and third switches.

8. The current supply of claim 7, wherein the controller is configured to provide a first mode in which the first switch is closed and the second and third switches are open, a second mode in which the second switch is closed and the first and third switches are open, and a third mode in which the second switch is closed and the first and second switches are open.

9. The current supply of claim 4, wherein an output of the variable current source is connected direct to the application.

10. The current supply of claim 4, further comprising a current mirror connecting an output of the variable current source to the application.

11. The current supply of claim 4, further comprising fourth switch connected to a second node in the current supply located between the second switch and the variable current source, and wherein the fourth switch is connected to the application.

12. The current supply of claim 4, further comprising an integrator including an op-amp and the second capacitor connected in parallel, the integrator coupling the third switch to a control input for the variable current source.

13. The current supply of claim 4, wherein the variable current source includes a transistor having a gate connected to the second capacitor.

14. A method of operating a current supply connected to an application, comprising:

charging a first capacitor to a first voltage;

discharging the first capacitor to a second voltage through a variable current source at a rate which is controlled by a third voltage on a second capacitor, the rate of flow of charge through the variable current source controlling the supply of current to the application;

connecting the first capacitor to the second capacitor to bring the second capacitor to a fourth voltage to adjust the rate of flow of charge through the variable current source; and recharging the first capacitor to the first voltage.

15. The method of claim 14, wherein the flow of charge through the variable current supply povides the current for the application.

16. The method of claim 14, further comprising connecting the application through the variable current source to ground.

17. The method of claim 14, further comprising mirroring the flow of charge through the variable current source with a current mirror to supply current to the application.

18. The method of claim 14, wherein the second voltage is substantially at ground.

* * * * *